US010327552B1

(12) United States Patent
Liu

(10) Patent No.: US 10,327,552 B1
(45) Date of Patent: Jun. 25, 2019

(54) RACK WITH TOP REACHING CEILING

(71) Applicant: Hsiao-Han Liu, Guangdong (CN)

(72) Inventor: Hsiao-Han Liu, Guangdong (CN)

( * ) Notice: Subject to any disclaimer, the term of this patent is extended or adjusted under 35 U.S.C. 154(b) by 0 days.

(21) Appl. No.: 15/995,146

(22) Filed: Jun. 1, 2018

(30) Foreign Application Priority Data

May 14, 2018 (CN) ..... 2018 2 0715664 U

(51) Int. Cl.

| | |
|---|---|
| ***A47B 96/06*** | (2006.01) |
| ***A47B 96/14*** | (2006.01) |
| ***A47B 45/00*** | (2006.01) |
| ***A47F 5/08*** | (2006.01) |

(52) U.S. Cl.
CPC ..... *A47B 96/06* (2013.01); *A47B 45/00* (2013.01); *A47B 96/1425* (2013.01); *A47F 5/08* (2013.01); *A47K 2201/00* (2013.01)

(58) Field of Classification Search
CPC ..... A47B 96/1425; A47B 96/06; A47B 45/00; A47B 57/26; A47K 2201/00; A47K 2201/02; A47K 2201/025; A47K 10/04; A47K 10/10; A47F 5/08
See application file for complete search history.

(56) References Cited

U.S. PATENT DOCUMENTS 2,272,446 A * 2/1942 Trask ..... A47B 61/003 248/251
2,991,040 A * 7/1961 Levy ..... A47F 5/08 108/108
3,018,898 A * 1/1962 Frazelle ..... A47B 96/1425 211/107
3,221,678 A * 12/1965 Doherty ..... A47B 57/26 108/106
3,323,851 A * 6/1967 Duboff ..... A47B 96/1425 211/107
5,083,729 A * 1/1992 Saeks ..... B62H 3/12 211/17
5,148,928 A * 9/1992 Arnold ..... A47B 55/02 211/153
5,605,238 A * 2/1997 Jacobs ..... A47B 47/0091 108/180
5,897,085 A * 4/1999 Cronin ..... A61G 7/053 248/200.1
5,913,783 A * 6/1999 Weener ..... A47B 96/1425 248/354.1
6,199,808 B1 * 3/2001 Lin ..... A47K 10/10 211/105
6,520,351 B1 * 2/2003 Zadro ..... A47K 3/281 211/106
6,550,730 B1 * 4/2003 Hong ..... A47B 57/26 108/147.13

(Continued)

*Primary Examiner* — Patrick D Hawn

(57) ABSTRACT

A rack with a top reaching a ceiling according to the present invention is easy to assemble and disassemble, and such fastening method will not damage the ceiling but has high stability and is firm and durable. In addition, an arc-shaped cross bar, with a shower curtain or other articles hanging thereon by buckles, can be inserted in and connected to the rack in the Y direction, so it has diversified functions. A three-dimensional structure of the rack can be realized, and telescopic cross bar, telescopic vertical bars and the arc-shaped cross bar can be connected by users according to different needs to structure racks of different shapes.

10 Claims, 4 Drawing Sheets

(56) References Cited

U.S. PATENT DOCUMENTS 6,796,442 B1 * 9/2004 Wu ..... A47K 10/04 211/105.1
6,820,842 B1 * 11/2004 Chuang ..... A47B 96/1425 248/125.8
7,600,299 B2 * 10/2009 Hendrickson ..... A47K 10/10 16/412
7,874,025 B2 * 1/2011 Bowden ..... A47K 3/003 211/105.1
8,348,072 B2 * 1/2013 Whitehall ..... A47B 57/26 211/107
9,693,660 B1 * 7/2017 Stelmarski ..... A47K 3/281
9,697,742 B2 * 7/2017 Faver ..... G09B 19/00
9,808,125 B2 * 11/2017 Jepson ..... A47K 3/281
10,051,985 B2 * 8/2018 Jones ..... A47K 3/38
2002/0158033 A1 * 10/2002 Chen ..... A47K 5/03 211/103
2004/0200792 A1 * 10/2004 Yang ..... A47K 10/04 211/99
2004/0217239 A1 * 11/2004 Chuang ..... A47B 96/1425 248/125.8
2005/0183638 A1 * 8/2005 Lin ..... A47B 5/00 108/51.11
2007/0151489 A1 * 7/2007 Byrne ..... A47B 21/02 108/95
2008/0308687 A1 * 12/2008 Terry ..... A47B 96/00 248/122.1
2010/0237032 A1 * 9/2010 Whitehall ..... A47B 57/26 211/107
2011/0284484 A1 * 11/2011 Lin ..... A47B 96/1425 211/45
2014/0255091 A1 * 9/2014 Baek ..... F16B 12/40 403/345
2015/0034581 A1 * 2/2015 Hsu ..... A47H 1/122 211/105.3
2015/0115119 A1 * 4/2015 Hart ..... A61G 5/14 248/274.1
2015/0327681 A1 * 11/2015 Hsieh ..... A47B 81/00 211/88.01
2017/0055780 A1 * 3/2017 Jepson ..... A47K 3/281
2017/0310090 A1 * 10/2017 Woodley ..... H02B 1/20
2017/0332818 A1 * 11/2017 Jones ..... A47K 3/38

* cited by examiner

RACK WITH TOP REACHING CEILING

BACKGROUND OF THE INVENTION

The present invention relates to the field of pipe supports, in particular to a rack with a top reaching a ceiling.

Existing common racks with a top reaching a ceiling generally include top bases, bottom bases, connecting bars and a hanging plate for placing articles, and are generally used in homes such as bathrooms and bedrooms. The racks can be used as toilet racks and bathroom racks, and can effectively improve the space utilization rate and the quality of life. Because of its convenience and practicality, it is widely popular with the public.

There are great defects existed in the racks with top reaching ceiling in the market, which are mainly reflected in the fact that the top bases resist against the ceiling, which easily causes the ceiling to upwarp and damages the ceiling. Moreover, the existing ceilings are not stable enough to fasten the connecting bars stably. As a result, the entire rack, which is not durable enough, cannot be well fastened but will be collapsed with a little strength, thus limiting the usage scenarios of the racks with top reaching ceiling.

In addition, the existing racks with top reaching ceiling cannot be fastened in multiple directions according to different usage requirements, and the fastening style is relatively simple.

BRIEF SUMMARY OF THE INVENTION

In order to solve the above problems, the present invention provides a rack with a top reaching a ceiling that is quick and easy to assemble, disassemble and use and is firm, durable and diversified.

In order to achieve the above objective, a technical solution employed in the present invention is as follows: a rack with a top reaching a ceiling is provided, including top bases, bottom bases, a telescopic cross bar, telescopic vertical bars and an S-shaped buckle-hanging plate, wherein each top base is provided with a vertical fastening plate perpendicular to a bottom surface, a pipe fastening element is arranged on a front side of the vertical fastening plate and a wall fastening element is arranged on a rear side thereof; an X-axis horizontal fastener in the horizontal direction is arranged on an upper side of the pipe fastening element and a Z-axis top base fastener which is vertically downward is arranged on a lower side thereof; each bottom base is provided with a horizontal fastening plate parallel to the ground, a base fastener is arranged on an upper side of the horizontal fastening plate and a ground fastening element is arranged on a lower side thereof; the top bases are connected by inserting and connecting the telescopic cross bar into the horizontal fasteners, and the top bases and the bottom bases are connected by inserting and connecting both ends of each telescopic vertical bar into the top base fastener and the bottom base fastener respectively; and an S-shaped buckle, by which the S-shaped buckle-hanging plate is clamped and fastened to the telescopic vertical bar, is arranged on one side of the S-shaped buckle-hanging plate.

It further includes an adapter, wherein the adapter is provided with a bayonet matched with the horizontal fastener and is fastened to the horizontal fastener of the vertical fastening plate by the bayonet; the adapter is also provided with Y-axis fasteners in the Y direction; and both ends of the telescopic cross bar are inserted in and fastened to the Y-axis fasteners.

Specifically, a clamping portion is further arranged on one side of the bayonet of the adapter, a corresponding clamping hole is formed on the front side of the vertical fastening plate, and the adapter is rotationally fastened to the vertical fastening plate by the clamping portion and the clamping hole.

It further includes an arc-shaped cross bar with both ends being inserted in and fastened to the Y-axis fastener.

The wall fastening element and the ground fastening element are both provided with non-slip rubber mats which are inserted in and connected to a rear side of the vertical fastening plate and a lower side of the horizontal fastening plate, respectively.

The horizontal fastener is provided with a convex annular insertion hole; and the telescopic cross bar is inserted in and fastened to the convex annular insertion hole.

The top base fastener is provided with a convex arc-shaped carrier base, a recessed insertion hole is arranged at a lower end of the arc-shaped carrier base, and the telescopic vertical bar is inserted in and fastened to the recessed insertion hole.

The telescopic cross bar and the telescopic vertical bars are formed by sheathing a plurality of steel pipes of which the length is adjusted by screws.

The adjustable length of the telescopic cross bar and the telescopic vertical bar ranges from 0 cm to 60 cm.

Specifically, the base fastener is provided with a convex annular receiver and the telescopic vertical bar is inserted in and fastened to the annular receiver.

Specifically, a top locking ring and a bottom locking ring are arranged on upper side and lower side of the S-shaped buckle respectively, and a bevel notch, through which the S-shaped buckle is clamped and fastened to the telescopic vertical bar by rotating, is arranged in the middle thereof.

The beneficial effect of the present invention is that the rack with a top reaching a ceiling according to the present invention is easy to assemble and disassemble, and only needs to be inserted in and fastened to the top bases and the bottom bases by the telescopic cross bar and the telescopic vertical bars respectively, and then the hanging plate can be fastened to the telescopic vertical bar by the S-shaped buckle. A side face of the top base is fastened to the wall instead of the ceiling, and the telescopic cross bar is inserted between the top bases. Such fastening method does not damage the ceiling but has high stability and is firm and durable.

In addition, the adapter can also be clamped and fastened to the top bases, then the telescopic bars are inserted and connected in the X and Y directions by the adapter, and an arc-shaped cross bar, with a shower curtain or other articles hanging thereon by buckles, can also be inserted in and connected to the rack in the Y direction, so it has diversified functions. The telescoping cross bar can be inserted in and connected in multiple directions to form a rectangular or arc structure, so that a three-dimensional structure of the rack can be realized, and telescopic cross bar, telescopic vertical bars and the arc-shaped cross bar can be connected by users according to different needs to structure racks of different shapes.

BRIEF DESCRIPTION OF THE DRAWINGS

FIG. 7 is a top view of the rack according to the present invention, in which:

1—Top base; 11—Vertical fastening plate; 12—Horizontal fastener; 121—Annular insertion hole; 13—Top base fastener; 131—Arc-shaped carrier base; 132—Recessed insertion hole; 14—Clamping hole;

2—Bottom base; 21—Horizontal fastening plate; 22—Bottom base fastener; 221—Annular receiver;

3—Telescopic cross bar; 4—Telescopic vertical bar;

5—S-shaped buckle-hanging plate; 51—S-shaped buckle; 511—Top locking ring; 512—Bottom locking ring;

6—Adapter; 61—Y-axis fastener; 62—Clamping portion;

7—Arc-shaped cross bar.

DETAILED DESCRIPTION OF THE INVENTION

Embodiment 1

Figure 1:
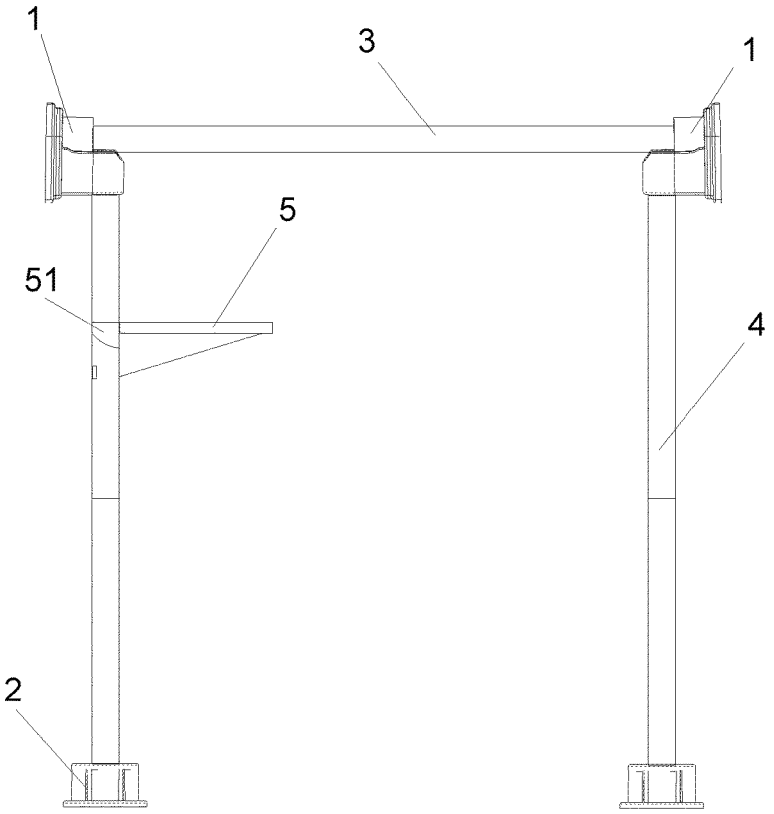
FIG. 1 is a structural diagram of a rack according to the present invention.
Figure 2:
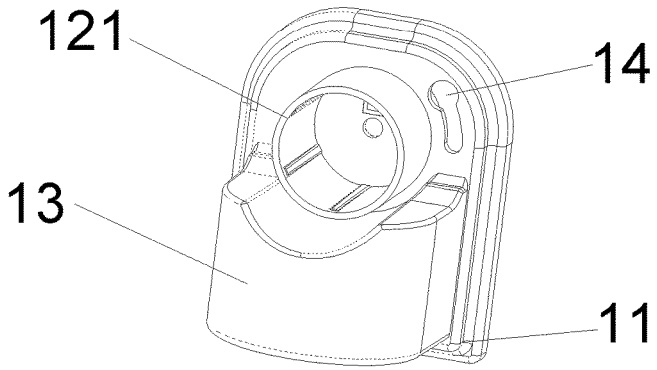
FIG. 2 is a structural diagram of a top base according to the present invention.
Figure 3:
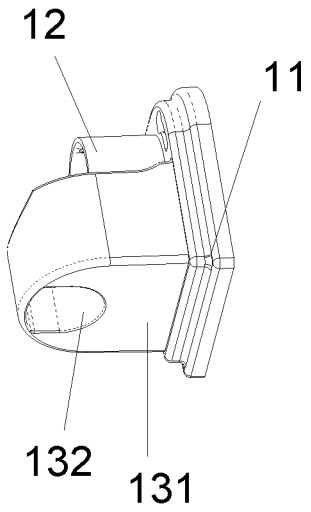
FIG. 3 is another solid structural diagram of the top base according to the present invention.
Figure 4:
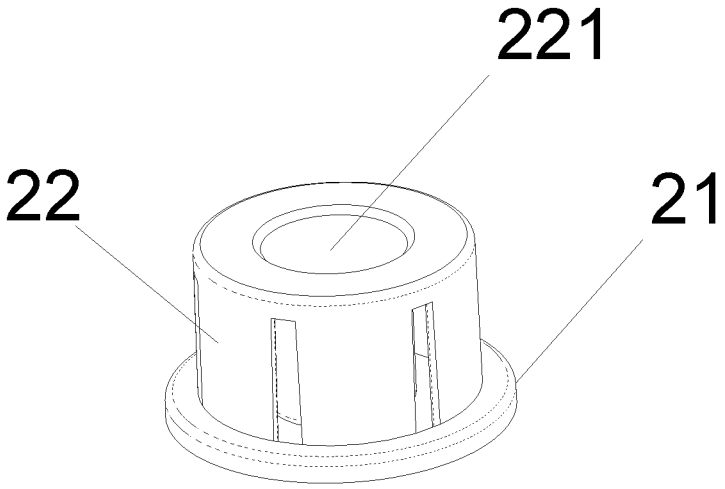
FIG. 4 is a solid structural diagram of a bottom base according to the present invention.
Figure 5:
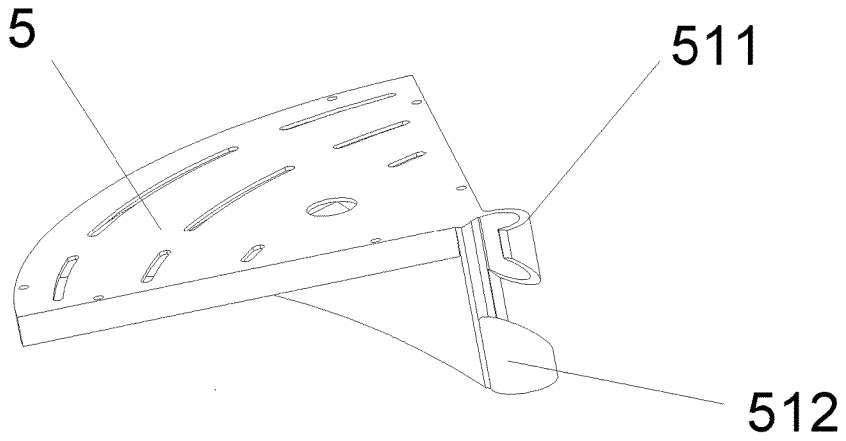
FIG. 5 is a solid structural diagram of an S-shaped buckle-hanging plate according to the present invention.

Please refer to FIGS. 1 to 5, this embodiment relates to a rack with a top reaching a ceiling, including top bases 1, bottom bases 2, a telescopic cross bar 3, telescopic vertical bars 4 and an S-shaped buckle-hanging plate 5, wherein each top base 1 is provided with a vertical fastening plate 11 perpendicular to a bottom surface, a pipe fastening element is arranged on a front side of the vertical fastening plate 11 and a wall fastening element is arranged on a rear side thereof; an X-axis horizontal fastener 12 in the horizontal direction is arranged on an upper side of the pipe fastening element and a Z-axis top base fastener 13 which is vertically downward is arranged on a lower side thereof; the bottom base 2 is provided with a horizontal fastening plate 21 parallel to the ground, a base fastener 22 is arranged on an upper side of the horizontal fastening plate 21 and a ground fastening element is arranged on a lower side thereof; the top bases 1 are connected by inserting and connecting the telescopic cross bar 3 into the horizontal fasteners 12, and the top bases 1 and the bottom bases 2 are connected by inserting and connecting both ends of each telescopic vertical bar 4 into the top base fastener 13 and the bottom base fastener 22 respectively; and an S-shaped buckle 51, by which the S-shaped buckle-hanging plate 5 is clamped and fastened to the telescopic vertical bar 4, is arranged on one side of the S-shaped buckle-hanging plate 5.

Specifically, the horizontal fastener 12 is provided with a convex annular insertion hole 121; and the telescopic cross bar 3 is inserted in and fastened to the convex annular insertion hole 121. The top base fastener 13 is provided with a convex arc-shaped carrier base 131 having a recessed insertion hole 132 arranged at a lower end thereof, and the telescopic vertical bar 4 is inserted in and fastened to the recessed insertion hole 132. The base fastener 22 is provided with a convex annular receiver 221 and the telescopic vertical bar 4 is inserted in and fastened to the annular receiver 221. A side face of the top base 1 is fastened to the wall instead of the ceiling, and the telescopic cross bar 3 is inserted between the top bases 1. Such fastening method does not damage the ceiling but has high stability and is firm and durable.

Specifically, a top locking ring 511 and a bottom locking ring 512 are arranged on upper side and lower side of the S-shaped buckle 51 respectively, and a bevel notch, through which the S-shaped buckle 51 is clamped and fastened to the telescopic vertical bar 4 by rotating, is arranged in the middle thereof. The telescopic vertical bar 4 is internally loaded in the bevel notch 7 and rotated to the inside of the locking ring, so that the locking holes of the top locking ring 511 and the bottom locking ring 512 respectively clamp an outer wall surface of the telescopic vertical bar 4 at a corresponding section, so that the S-shaped buckle-hanging plate and the telescopic vertical bar 4 are fixedly locked eventually. Arc-shaped ventilation holes are formed on the surface of the plate for placing articles on the S-shaped buckle-hanging plate 5, which can avoid water accumulation.

The telescopic cross bar 3 and the telescopic vertical bars are formed by sheathing a plurality of steel pipes. The adjustable length of the telescopic cross bar and the telescopic vertical bar ranges from 0 cm to 60 cm. Users can adjust the length of the steel pipes by screws during assembly according to different needs so as to fasten the entire structure.

The lower bases 2 are fastened to the ground by pressure, and the top bases 1 are fastened to the wall by pressure and friction. Such fastening method does not require screws, so it is easy to assemble and disassemble, and has more extensive application scenarios.

Embodiment 2

Figure 6:
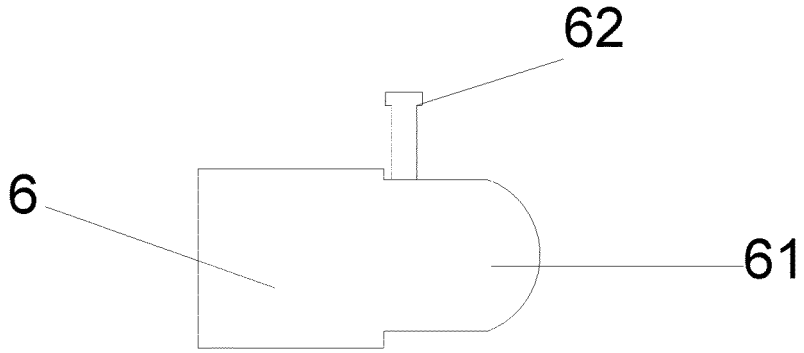
FIG. 6 is a structural diagram of an adapter according to the present invention.
Figure 7:
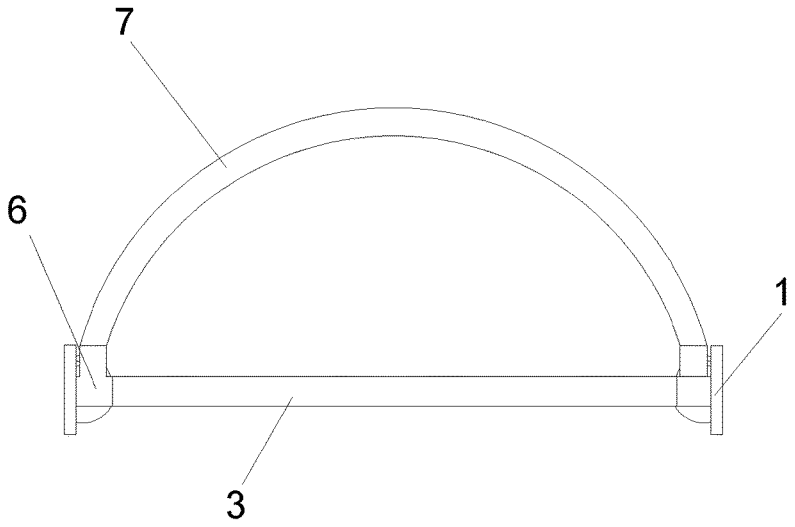

Please refer to FIGS. 1 to 7, this embodiment relates to a rack with a top reaching a ceiling, including top bases 1, bottom bases 2, a telescopic cross bar 3, telescopic vertical bars 4 and an S-shaped buckle-hanging plate 5, wherein each top base 1 is provided with a vertical fastening plate 11 perpendicular to a bottom surface, a pipe fastening element is arranged on a front side of the vertical fastening plate 11 and a wall fastening element is arranged on a rear side thereof; an X-axis horizontal fastener 12 in the horizontal direction is arranged on an upper side of the pipe fastening element and a Z-axis top base fastener 13 which is vertically downward is arranged on a lower side thereof; each bottom base 2 is provided with a horizontal fastening plate 21 parallel to the ground, a base fastener 22 is arranged on an upper side of the horizontal fastening plate 21 and a ground fastening element is arranged on a lower side thereof; the top bases 1 are connected by inserting and connecting the telescopic cross bar 3 into the horizontal fasteners 12, and the top bases 1 and the bottom bases 2 are connected by inserting and connecting both ends of each telescopic vertical bar 4 into the top base fastener 13 and the bottom base fastener 22 respectively; and an S-shaped buckle 51, by which the S-shaped buckle-hanging plate 5 is clamped and fastened to the telescopic vertical bar 4, is arranged on one side of the S-shaped buckle-hanging plate 5.

It further includes an adapter 6, wherein the adapter 6 is provided with a bayonet matched with the horizontal fastener 12 and is fastened to the horizontal fastener 12 of the vertical fastening plate 11 by the bayonet; the adapter 6 is also provided with Y-axis fasteners 61 in the Y direction; and both ends of the telescopic cross bar 3 are inserted in and fastened to the Y-axis fasteners 61.

A clamping portion 62 is further arranged on one side of the bayonet of the adapter 6, a corresponding clamping hole 14 is formed on the front side of the vertical fastening plate 11, and the adapter 6 is rotationally fastened to the vertical fastening plate 11 by the clamping portion 62 and the clamping hole 14.

It further includes an arc-shaped cross bar 7 with both ends being inserted in and fastened to the Y-axis fastener 62. When being used in the bathroom, both ends of the telescopic cross bar 3 are inserted in and fastened to the horizontal fastener 12 in the X direction, and both ends of the arc-shaped cross bar 7 are inserted in and fastened to the Y-axis fastener 62 of the adapter, so that the shower curtain can be hung on the arc-shaped cross bar 7 to form a bathroom structure. A three-dimensional structure of the rack can be realized through the adapter 6, and telescopic cross bar 3, telescopic vertical bars 4 and the arc-shaped cross bar 7 can be connected by users according to different needs to structure racks of different shapes.

Embodiment 3

Please refer to FIGS. 1 to 7, this embodiment relates to a rack with a top reaching a ceiling, including top bases 1, bottom bases 2, a telescopic cross bar 3, telescopic vertical bars 4 and an S-shaped buckle-hanging plate 5, wherein each top base 1 is provided with a vertical fastening plate 11 perpendicular to a bottom surface, a pipe fastening element is arranged on a front side of the vertical fastening plate 11 and a wall fastening element is arranged on a rear side thereof; an X-axis horizontal fastener 12 in the horizontal direction is arranged on an upper side of the pipe fastening element and a Z-axis top base fastener 13 which is vertically downward is arranged on a lower side thereof; each bottom base 2 is provided with a horizontal fastening plate 21 parallel to the ground, a base fastener 22 is arranged on an upper side of the horizontal fastening plate 21 and a ground fastening element is arranged on a lower side thereof; the top bases 1 are connected by inserting and connecting the telescopic cross bar 3 into the horizontal fasteners 12, and the top bases 1 and the bottom bases 2 are connected by inserting and connecting both ends of each telescopic vertical bar 4 into the top base fastener 13 and the bottom base fastener 22 respectively; and an S-shaped buckle 51, by which the S-shaped buckle-hanging plate 5 is clamped and fastened to the telescopic vertical bar 4, is arranged on one side of the S-shaped buckle-hanging plate 5.

Specifically, the horizontal fastener 12 is provided with a convex annular insertion hole 121; and the telescopic cross bar 3 is inserted in and fastened to the convex annular insertion hole 121. The top base fastener 13 is provided with a convex arc-shaped carrier base 131 having a recessed insertion hole 132 arranged at a lower end thereof, and the telescopic vertical bar 4 is inserted in and fastened to the recessed insertion hole 132. The base fastener 22 is provided with a convex annular receiver 221 and the telescopic vertical bar 4 is inserted in and fastened to the annular receiver 221. A side face of the top base 1 is fastened to the wall instead of the ceiling, and the telescopic cross bar 3 is inserted between the top bases 1. Such fastening method does not damage the ceiling but has high stability and is firm and durable.

Specifically, a top locking ring 511 and a bottom locking ring 512 are arranged on upper side and lower side of the S-shaped buckle 51 respectively, and a bevel notch, through which the S-shaped buckle 51 is clamped and fastened to the telescopic vertical bar 4 by rotating, is arranged in the middle thereof. The telescopic vertical bar 4 is internally loaded in the bevel notch and rotated to the inside of the locking ring, so that the locking holes of the top locking ring 511 and the bottom locking ring 512 respectively clamp an outer wall surface of the telescopic vertical bar 4 at a corresponding section, so that the S-shaped buckle-hanging plate and the telescopic vertical bar 4 are fixedly locked eventually. Arc-shaped ventilation holes are formed on the surface of the plate for placing articles on the S-shaped buckle-hanging plate 5, which can avoid water accumulation.

It further includes an adapter 6, wherein the adapter 6 is provided with a bayonet matched with the horizontal fastener 12 and is fastened to the horizontal fastener 12 of the vertical fastening plate 11 by the bayonet; the adapter 6 is also provided with Y-axis fasteners 61 in the Y direction; and both ends of the telescopic cross bar 3 are inserted in and fastened to the Y-axis fasteners 61.

A clamping portion 62 is further arranged on one side of the bayonet of the adapter 6, a corresponding clamping hole 14 is formed on the front side of the vertical fastening plate 11, and the adapter 6 is rotationally fastened to the vertical fastening plate 11 by the clamping portion 62 and the clamping hole 14.

It further includes an arc-shaped cross bar 7 with both ends being inserted in and fastened to the Y-axis fastener 62. When being used in the bathroom, both ends of the telescopic cross bar 3 are inserted in and fastened to the horizontal fastener 12 in the X direction, and both ends of the arc-shaped cross bar 7 are inserted in and fastened to the Y-axis fastener 62 of the adapter, so that the shower curtain can be hung on the arc-shaped cross bar 7 to form a bathroom structure, so that the three-dimensional structure of the rack can be realized through the adapter 6, and the telescopic cross bar 3, the telescopic vertical bars 4 and the arc-shaped cross bar 7 can be connected according to different needs to structure racks of different shapes.

In the specific embodiments 1 to 3, the wall fastening element and the ground fastening element are both provided with non-slip rubber mats which are inserted in and connected to a rear side of the vertical fastening plate 11 and a lower side of the horizontal fastening plate 21, respectively, to increase the friction between the top bases 1 and the wall and between the lower bases 2 and the ground, thereby making the fixation more reliable.

Further, the S-shaped buckle-hanging plate 5 described in the embodiments 1 to 3 includes an integrated S-shaped buckle-hanging plate 5 and a detachable S-shaped buckle-hanging plate 5, wherein the detachable S-shaped buckle-hanging plate 5 includes an S-shaped buckle 51 and a hanging plate; after the S-shaped buckle 51 is clamped and fastened to the telescopic vertical bar 4, the hanging plate is fixed by inserting and connecting a hook onto a bayonet on an upper edge of the S-shaped buckle 51. A convex hook portion is also arranged on a lower edge of the S-shaped buckle 51, and the hanging plate can also be fixed by putting and connecting a clamping hole onto the hook portion of the S-shaped buckle 51, so that the fastening methods are diverse, and the requirements of the hanging plates with different fastening methods can be met.

Compared with the prior art, the rack with a top reaching a ceiling in this embodiment is easy to assemble and disassemble, so that a three-dimensional structure of the rack can be realized, and the telescopic cross bar 3, the telescopic vertical bars 4 and the arc-shaped cross bar 7 can be connected by users according to different needs to structure racks of different shapes. For assembling, the adapter 6 is clamped and fastened to the top base 1, the telescopic cross bar 3 is inserted in and fastened to the top bases 1, and then two telescopic vertical bars 4 are inserted in and fastened to the top bases 1 and the bottom bases 2 respectively, wherein the hanging plate 5 is fastened to the telescopic vertical bar 4 by the S-shaped buckle, and finally the arc-shaped cross bar 7 is inserted in and connected to the Y-axis fastener 61 by the adapter 6 so that a shower curtain or other articles may be hanged on the arc-shaped cross bar 7. A side face of the top base 1 is fastened to the wall instead of the ceiling, and the telescopic cross bar 3 is inserted between the top bases 1. Such fastening method does not damage the ceiling but has high stability and is firm and durable.

The above embodiments merely describe the preferred embodiments of the present invention, and are not intended to limit the scope of the present invention. Without departing from the spirit of the present invention, various modifications and improvements made by persons of ordinary skill in the art to the technical solution of the present invention shall all fall within the protection scope defined by the claims of the present invention.

What is claimed is:

1. A rack, comprising top bases, bottom bases, a telescopic cross bar, telescopic vertical bars and an S-shaped buckle-hanging plate, wherein each top base is provided with a vertical fastening plate perpendicular to a bottom surface of the top base, a pipe fastening element is arranged on a front side of the vertical fastening plate and a wall fastening element is arranged on a rear side thereof; an X-axis horizontal fastener in an horizontal direction is arranged on an upper side of the pipe fastening element and a Z-axis top base fastener which is vertically downward is arranged on a lower side thereof; each bottom base is provided with a horizontal fastening plate parallel to the ground, a bottom base fastener is arranged on an upper side of the horizontal fastening plate and a ground fastening element is arranged on a lower side thereof; the top bases are connected by inserting and connecting the telescopic cross bar into the X-axis horizontal fasteners, and the top bases and the bottom bases are connected by inserting and connecting both ends of each telescopic vertical bar into the corresponding Z-axis top base fastener and the corresponding bottom base fastener respectively; and an S-shaped buckle is arranged on one side of the S-shaped buckle-hanging plate; the S-shaped buckle-hanging plate is clamped and fastened to one of the telescopic vertical bars via the S-shaped buckle.

2. The rack according to claim 1, further comprising adapters, wherein each of the adapters is fastened to the X-axis horizontal fastener of the vertical fastening plate of a corresponding top base; each adapter is also provided with a Y-axis fastener in a Y direction.

3. The rack according to claim 2, wherein a clamping portion is further arranged on one side of each adapter, a corresponding clamping hole is formed on the front side of the vertical fastening plate of a corresponding top base, and each adapter is rotationally fastened to the vertical fastening plate by the clamping portion and the clamping hole.

4. The rack according to claim 2, further comprising an arc-shaped cross bar with both ends being inserted in and fastened to the Y-axis fasteners.

5. The rack according to claim 1, wherein the wall fastening element and the ground fastening element are both provided with non-slip rubber mats which are inserted in and connected to a rear side of the vertical fastening plate and a lower side of the horizontal fastening plate, respectively.

6. The rack according to claim 1, wherein the X-axis horizontal fastener is provided with a convex annular insertion hole; and the telescopic cross bar is inserted in and fastened to the convex annular insertion hole.

7. The rack according to claim 1, wherein the Z-axis top base fastener is provided with a convex arc-shaped carrier base having a recessed insertion hole arranged at a lower end thereof, and the telescopic vertical bar is inserted in and fastened to the recessed insertion hole.

8. The rack according to claim 1, wherein the telescopic cross bar and the telescopic vertical bars are formed by sheathing a plurality of steel pipes; a total length of the steel pipes is adjusted by screws, and adjustable lengths of the telescopic cross bar and each telescopic vertical bar range from 0 cm to 60 cm.

9. The rack according to claim 1, wherein each bottom base fastener is provided with a convex annular receiver and a corresponding telescopic vertical bar is inserted in and fastened to the annular receiver.

10. The rack according to claim 1, wherein a top locking ring and a bottom locking ring are arranged on an upper side and a lower side of the S-shaped buckle respectively, and a bevel notch, through which the S-shaped buckle is clamped and fastened to a corresponding telescopic vertical bar by rotating, is arranged in the middle thereof.

* * * * *